US011981497B2

(12) United States Patent
Jung et al.

(10) Patent No.: US 11,981,497 B2
(45) Date of Patent: May 14, 2024

(54) FOOD CONTAINER USING HEATING ELEMENT

(71) Applicants: Mi Sub Jung, Osan-si (KR); Ki Ryong Song, Gwacheon-si (KR); Kyung A Kwon, Uijeongbu-si (KR)

(72) Inventors: Mi Sub Jung, Osan-si (KR); Ki Ryong Song, Gwacheon-si (KR); Kyung A Kwon, Uijeongbu-si (KR)

( * ) Notice: Subject to any disclaimer, the term of this patent is extended or adjusted under 35 U.S.C. 154(b) by 441 days.

(21) Appl. No.: 16/766,993

(22) PCT Filed: Dec. 30, 2019

(86) PCT No.: PCT/KR2019/016006
§ 371 (c)(1),
(2) Date: Jul. 8, 2021

(87) PCT Pub. No.: WO2020/106070
PCT Pub. Date: May 28, 2020

(65) Prior Publication Data

US 2021/0347552 A1 Nov. 11, 2021

(30) Foreign Application Priority Data

Nov. 21, 2018 (KR) ..... 10-2018-0144728

(51) Int. Cl.

| | |
|---|---|
| ***B65D 81/34*** | (2006.01) |
| ***B65D 6/10*** | (2006.01) |
| ***B65D 25/04*** | (2006.01) |
| ***B65D 77/04*** | (2006.01) |
| ***B65D 77/22*** | (2006.01) |

(52) U.S. Cl.
CPC ..... *B65D 81/3484* (2013.01); *B65D 11/16* (2013.01); *B65D 25/04* (2013.01); *B65D 77/0453* (2013.01); *B65D 77/225* (2013.01); *B65D 2577/041* (2013.01)

(58) Field of Classification Search
CPC .. B65D 81/3484; B65D 77/225; B65D 11/16; B65D 25/04; B65D 77/0453; B65D 2577/041
See application file for complete search history.

(56) References Cited

U.S. PATENT DOCUMENTS

| | | | |
|---|---|---|---|
| 5,295,475 | A | 3/1994 | Kaneko |
| 2017/0153043 | A1 | 6/2017 | Young |

FOREIGN PATENT DOCUMENTS

| | | | |
|---|---|---|---|
| JP | 05-005174 | Y2 | 2/1993 |
| JP | 05-088321 | U | 12/1993 |
| JP | 2013-049439 | A | 3/2013 |
| KR | 20-0229200 | Y1 | 7/2001 |
| KR | 20-0288122 | Y1 | 9/2002 |
| KR | 20-2009-0009347 | U | 9/2009 |

*Primary Examiner* — Drew E Becker
*Assistant Examiner* — Chaim A Smith
(74) *Attorney, Agent, or Firm* — NKL LAW; Jae Youn Kim

(57) ABSTRACT

A food container using a heating element, which container enhances convenience since a user can simply inject water toward the heating element by opening an inflow passage of an outer container without removing an inner container, and can keep the heating element stable in a simplified structure since a space containing the heating element inside the outer container and a space containing water are formed to be divided by a protrusion jaw but to communicate with each other.

7 Claims, 11 Drawing Sheets

FOOD CONTAINER USING HEATING ELEMENT

TECHNICAL FIELD

The present invention relates to a food container using a heating element, and more particularly, to a food container using a heating element with an improved structure, which is easy to inject water for generating heat from the heating element without transferring foods heated by heat reacting with water to another container, and continuously causes a heating reaction with water while keeping the heating element in the container in stability.

BACKGROUND ART

In the modern society, instant food products of various kinds for saving time and for convenience are coming to the fore. There are hamburgers, pizzas, noodles that people can eat when adding hot water to the noodles processed first, canned provisions in which fish, meat or vegetables processed first are contained, and packed lunch products such as cooked rice or Gimbap as the instant food products.

Commercialized instant products are available in case of need at places where users want to eat since having a relatively longer shelf life, but in case of the packed lunch products such as cooked rice or Gimbap, it is recommended that the users generally use the packed lunch products on the day of the purchase due to decomposition.

Moreover, in order to improve tastes of the instant foods or prevent food poisoning caused by decomposition of the instant foods, people adopt a method of reheating the foods for keeping the foods warm especially in winter.

However, because a user has to prepare a heating means, such as a burner, in order to heat the instant foods outdoors, it is very inconvenient in handling and managing them.

In order to solve the above-mentioned problems, recently, food containers using heating elements for heating foods stored in containers by generating heat from the heating elements disposed in the containers have been developed.

Korean Utility Model Registration No. 20-0229200 discloses a disposable meal set including: a heating element packing stand for heating a food container; staple food and side dish packing container in which cooked foods are vacuum-packed; paper-made cases for allowing a user to help himself or herself from the food container of staple food and side dish; and packing bags for sealing the cases one by one.

The disposable mal set disclosed in Korean Utility Model Registration No. 20-0229200 allows a user to eat a heated-up meal outdoors using the heating element packing stand, but has inconvenience that the user has to fold the cases to help himself or herself from the food container after the staple food and side dish packing container is heated up.

Korean Utility Model Publication No. 20-2009-0009347 discloses a heating container having a heating element put in a main body to generate heat by reacting with water so as to heat a food container in which food is put. The heating container disclosed in Korean Utility Model Publication No. 20-2009-0009347 includes: a main body having an inner container, in which food is put, and, which is inserted from the top into the main body to be spaced apart from the bottom surface and the side surface at a predetermined interval; a sealing cover for covering the main body and the inner container together; and a discharge hole formed at one side of the top of the main body to discharge vapor of water heated by reaction with the heating element in the main body.

However, the heating container disclosed in Korean Utility Model Publication No. 20-2009-0009347 has inconvenience that the user opens the sealing cover, removes the inner container in which food is put, injects water into the main body, and puts the sealing cover on the main body to seal the main body after inserting the inner container into the main body again. That is, the conventional heating container is inconvenient in injecting water to generate heat from the heating element.

Furthermore, Korean Utility Model Registration No. 20-0288122 (granted on Aug. 23, 2002) discloses a heating lunch box for instant cooking including: a food container having an open space; an insulated container having an upwardly open space in which a heating element bag and a heating solution bag are stacked on the floor surface; a container body having an upward open space so that the insulated container is inserted and a food container support member disposed at one side to support the food container when rotating; a bag joining member, which is provided on the floor surface of the insulated container so that the heating element bag and the heating solution bag are stacked, of which one side is joined to a contact part of one side of the heating element bag and a contact part of one side of the heating solution bag in a folded state, and which has a broken line of a predetermined length formed at an intermediate position; a pulling string of which one end passes the container body and the insulated container, extends downwards while surrounding the contact parts of the bags, is fixed on the opposite side of the broken line of the bag joining member, and tears the heating element bag and the heating solution bag at the same time while moving from the broken line when a user pulls the string; a food container cover for covering the food container in which food is stored while surrounding the upper part and the side surface of the container body from the top; and an insulated cover provided in the cover for covering the container body to block heat generated from the container body and to keep warm when the cover is combined.

However, such a conventional heating lunch box has a disadvantage in that its structure is complicated and manufacturing costs are increased since a vertical rib must be formed in order to prevent the heating element bag and the heating solution bag from being pushed to one side when the user tears the heating element bag and the heating solution bag by the pulling string.

PATENT LITERATURE

Patent Documents

Patent Document 1: Korean Utility Model Registration No. 20-0229200

Patent Document 2: Korean Utility Model Publication No. 20-2009-0009347

DISCLOSURE

Technical Problem

Accordingly, the present invention has been made in an effort to solve the above-mentioned problems occurring in the prior arts, and it is an object of the present invention to provide a food container using a heating element, which is easy to inject water for generating heat from the heating element without transferring heated foods to another container.

It is another object of the present invention to provide a food container using a heating element, in which the heating element continuously reacts with water while keeping the heating element in the container in stability without any additional element for supporting the heating element.

Technical Solution

To achieve the above objects, the present invention provides a food container using a heating element including: an outer container which contains a heating element generating heat by reaction with water and has a first extension part extending outwards from the edge of one side and an inflow passage formed inside the first extension part so that water flows into the outer container; an inner container which contains foods, has a shape corresponding to the outer container to be combined with an upper side of the outer container, and has a second extension part formed at the edge of one side to be coupled with the first extension part of the outer container in order to close the inflow passage; and a cover combined with an upper portion of the inner container, wherein the outer container has a coupling rib protruding upwards along the edge of the upper side and the inner container has a fitting groove formed along the edge of the upper side in such a way that the coupling rib is insertion-coupled with the fitting groove, so that the outer container and the inner container are coupled with each other in an insertion type, and the first extension part has a plate-type flange formed at the edge portion and the intermediate part of the first extension part becomes a part of the inflow passage, the second extension part is formed in a plate-type flange, the first extension part of the outer container has a coupling protrusion protruding upwards from an end portion, and the second extension part of the inner container has a coupling groove formed at an end portion so that the coupling protrusion is insertion-coupled with the coupling groove.

Moreover, the second extension part of the inner container has a collapsible line formed in a diagonal line between the inner container and the coupling groove.

Furthermore, the second extension part of the inner container has a vapor discharge hole formed between the inner container and the coupling groove and a pressure valve is combined with the vapor discharge hole, and the pressure valve includes: a body formed in a bolt type of which the lower side has a diameter smaller than that of the vapor discharge hole and having a truncated cone shape of which the diameter of the lower side gets gradually increased; a nut coupled with the lower side of the body below the second extension part of the inner container; and a spring mounted on the outer circumference of the body between the nut and the second extension part of the inner container.

Additionally, the first extension part and the second extension part respectively have hand-grips extending outwards, and the hand-grip of the first extension part and the hand-grip of the second extension part are not overlapped with each other but are misaligned.

Moreover, the outer container has a seating recess formed in the middle part and having a shape corresponding to that of the heating element so that the heating element is not moved, and the seating recess communicates with the inflow passage.

Furthermore, the inner container is partitioned into two or more food containing spaces formed by a partition wall, and the cover has a fitting groove which is coupled with the edge and the partition wall of the inner container in an insertion type.

In another aspect of the present invention, the outer container further includes: surplus space parts formed at both sides of the seating recess by protrusion jaws protruding upwards from the bottom surface of the seating recess; and communication holes respectively formed in the protrusion jaws at both sides of the seating recess to communication with the seating recess, so that water flowing into the seating recess of the outer container through the inflow passage is dispersed into the surplus space parts, and when the water in the seating recess is consumed by a heating reaction between the heating element and the water, the water contained in the surplus space parts flows into the seating recess to continuously keep the heating reaction of the heating element.

Advantageous Effects

The food container using a heating element according to the present invention allows a user to eat foods in the inner container immediately without transferring heated foods to another container and to simply inject water toward the heating element by opening an inflow passage of the outer container without removing the inner container, thereby promoting convenience. Additionally, the food container using a heating element according to the present invention can keep the heating element stable in a simplified structure since the space containing the heating element inside the outer container and the space containing water are formed to be divided by a protrusion jaw but to communicate with each other. In addition, food container using a heating element according to the present invention can effectively heat foods since the heating element containing space and the water containing space communicate with each other so that water and the heating element react with each other continuously.

MODE FOR INVENTION

Figure 1:
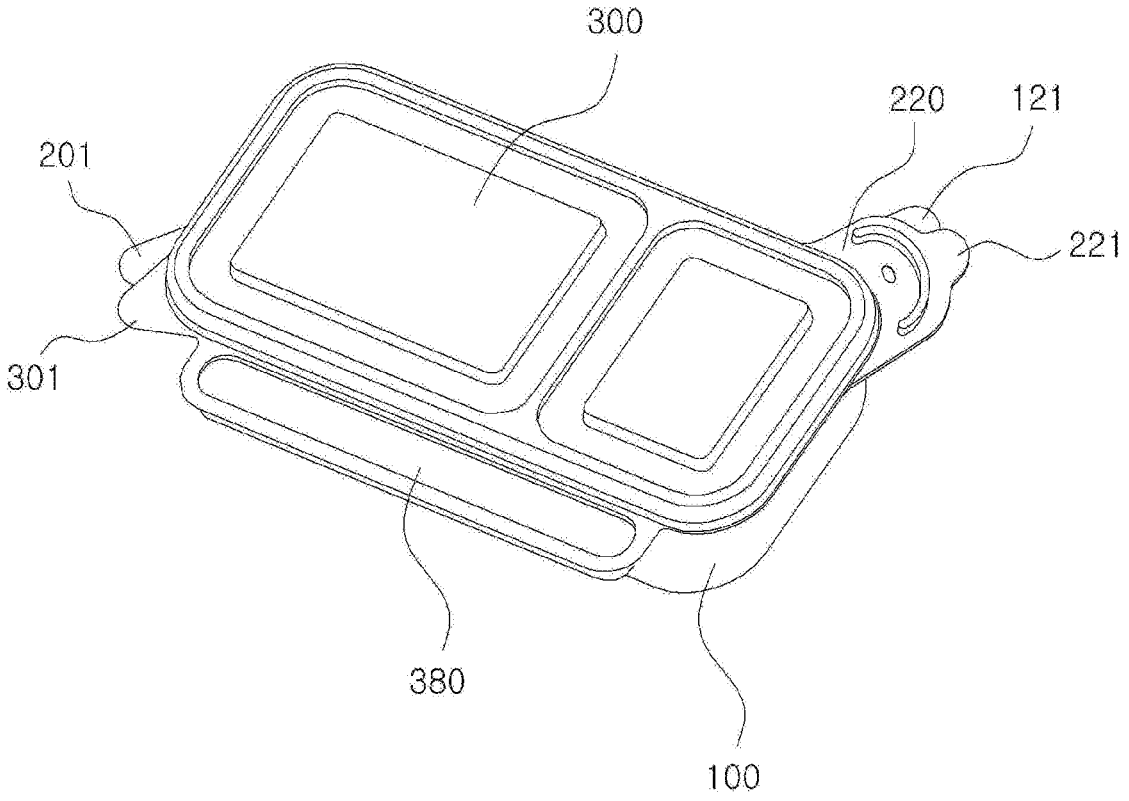
FIG. 1 is a perspective view of a food container using a heating element according to an embodiment of the present invention.

Hereinafter, a food container using a heating element will be now made in detail to the preferred embodiments of the present invention with reference to the attached drawings. In description of the present invention, it will be understood that terms of components shall not be interpreted as the meaning to limit technical components of the present invention since being named in consideration of functions of the components.

Referring to FIGS. 1 to 5, the food container using the heating element according to a preferred embodiment of the present invention can heat foods stored in a container using a heating element generating heat by reaction with water, and includes an outer container 100 in which the heating element is contained, an outer container 200 in which foods are stored, and a cover 300 for sealing the inner container 200.

The outer container 100 has a predetermined space for containing the heating element. For instance, the outer container 100 may be a cuboid container. Moreover, the outer container 100 has a coupling rib 110 protruding to a predetermined height along the rectangular edge of the upper side. Furthermore, the outer container 100 includes a first extension part 120 extending outwards from the edge of one side. Here, the first extension part 120 has an inflow passage 130 formed therein so that water flows into the outer container 100. The water flowing into the outer container 100 through the inflow passage 130 of the first extension part 120 generates heat by reacting the heating element contained in the outer container 100.

In the meantime, the heating element may be a heating pack in which a heating material generating heat by reaction with water is contained. Additionally, the heating material may be any one among quicklime, potassium hydroxide, calcium chloride, magnesium chloride, calcium carbonate, calcium hydroxide, sodium bicarbonate, and aluminum, or mixture in which at least twos among quicklime, potassium hydroxide, calcium chloride, magnesium chloride, calcium carbonate, calcium hydroxide, sodium bicarbonate, and aluminum are mixed.

The inner container 200 has a predetermined space in which foods are contained. The inner container 200 has a shape corresponding to that of the outer container 100, and is joined to the upper side of the outer container 100. Here, the inner container 200 has a fitting groove formed along the rectangular edge of the upper side thereof so that the coupling rib 110 of the outer container 100 is fit and coupled to the fitting groove. Additionally, the inner container 200 includes a second extension part 220 extending outwards from the edge of one side. The second extension part 220 has a shape corresponding to that of the first extension part 120 of the outer container 100, and is joined with the first extension part 110 of the outer container 100 to close the inflow passage 130 of the outer container 100. Here, the second extension part 220 of the inner container 200 is overlapped with the first extension part when the outer container 100 and the inner container 200 are combined with each other, so that the inflow passage 130 of the outer container 100 is closed.

The cover 300 is joined to the upper portion of the inner container 200. The cover 300 has a shape corresponding to that of the inner container 200, namely, a rectangular plate shape, and has a fitting groove formed along the edge of the bottom surface. In addition, when an upper edge portion 210 of the inner container 200 and the fitting groove of the cover 300 are combined with each other, the inner container 200 is sealed.

Figure 6:
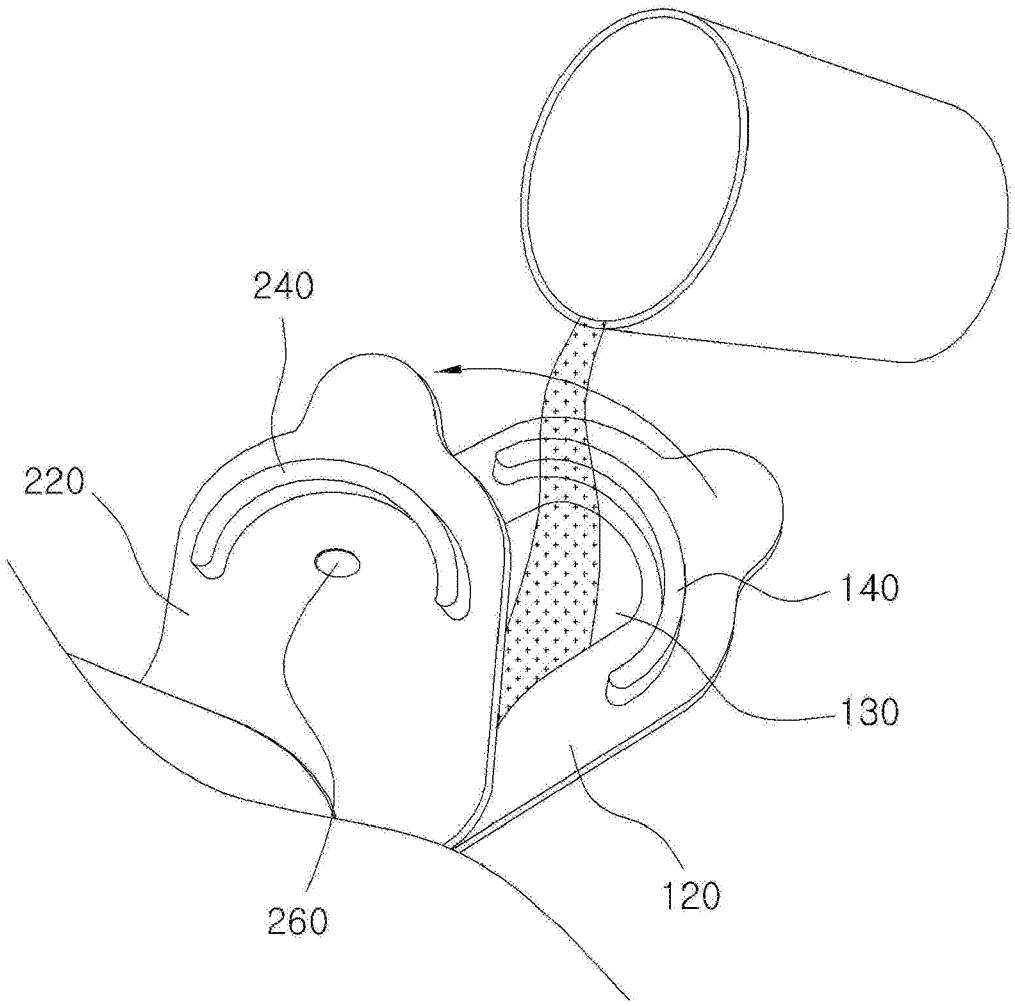
FIG. 6 is a view showing a used example of the food container using the heating element according to the embodiment of the present invention.

Therefore, when the second extension part 220 of the inner container 200 is separated from the first extension part 120 of the outer container 100, a part of the inflow passage 130 of the outer container 100 is exposed out (see FIG. 6). In this instance, when a user injects water into the inflow passage 130 and closes the first extension part 120 of the outer container 100 and the second extension part 220 of the inner container 200, the heating element generates heat, and the foods contained in the inner container 200 are heated. When the foods are heated to some degree, the user removes the cover 300 and conveniently has the foods contained in the inner container 200.

As described above, the food container using the heating element according to the preferred embodiment of the present invention allows the user to eat foods in the inner container 200 immediately without transferring heated foods to another container and to simply inject water toward the heating element by opening the inflow passage 130 of the outer container 100 without removing the inner container 200 from the outer container 100.

Preferably, the outer container 100 and the inner container 200 are combined with each other by insertion-coupling of the coupling rib 110 and the fitting groove, so that the inner container 200 can be sealed firmly.

In the meantime, the first extension part 120 of the outer container 100 has a plate-type flange formed at the edge portion, and has a part of the inflow passage 130 formed at the intermediate part. That is, the inflow passage 130 extends from the inside of the outer container 100 toward the first extension part 120. Moreover, the second extension part 220 of the inner container 200 is generally formed in a plate type flange. Therefore, the inflow passage 130 is closed when the first extension part 120 of the outer container 100 and the second extension part 220 of the inner container 200 are overlapped and get in contact with each other, but the inflow passage 130 is opened when the first extension part 120 and the second extension part 220 are spaced apart from each other.

Furthermore, the first extension part 120 of the outer container 100 has streamlined end portion, and a coupling protrusion 140 protruding upwards from the streamlined end portion. The coupling protrusion 140 of the first extension part 120 may be formed in a streamlined type along the streamlined end portion of the first extension part 120. Additionally, the second extension part 220 of the inner container 200 has a coupling groove 240 disposed at an end portion so that the coupling protrusion 140 is insertion-coupled with the coupling groove 240. The coupling groove 240 is formed in a streamlined shape like the coupling protrusion 140.

When the outer container 100 and the inner container 200 are combined with each other through the coupling structure of the first extension part 120 of the outer container 100 and the second extension part 220 of the inner container 200, the rectangular edge parts of the outer container 100 and the inner container 200 and the end portions of the first extension part 120 and the second extension part 220 are sealed, and the intermediate parts of the first extension part 120 and the second extension part 220, namely, a space between the outer container (or the inner container) and the first extension part (or the second extension part) is not sealed. Therefore, when water is injected through the inflow passage 130 and the heating element generates heat, vapor is generated from the inside of the outer container 100 and pressure rises. In this instance, vapor may be discharged between the first extension part 120 and the second extension part 220 in a lateral direction.

Figure 7:
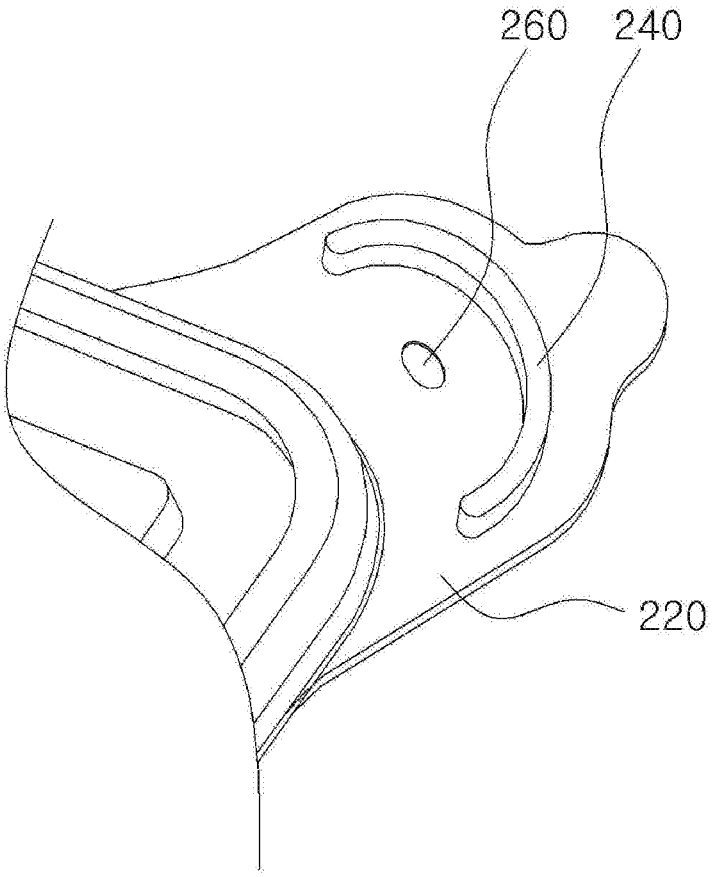
FIG. 7 is an enlarged view of a second extension part of the food container using the heating element according to the embodiment of the present invention.

Preferably, as shown in FIG. 7, the second extension part 220 of the inner container 200 has a vapor discharge hole 260 disposed between the inner container 200 and the coupling groove 240. The vapor discharge hole 260 is vertically formed above the inflow passage 130 so as to discharge vapor generated from the inside of the outer container 100 to the outside.

Figure 8:
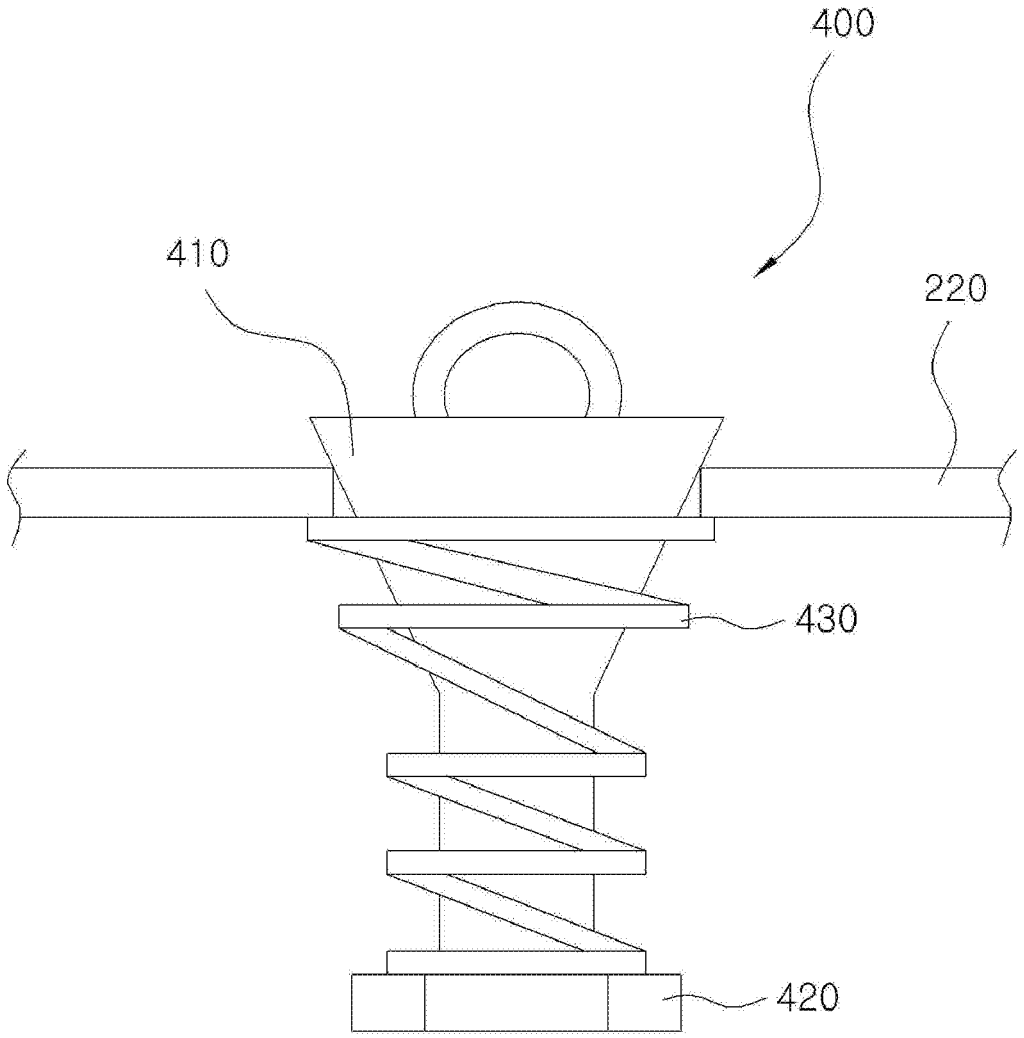
FIG. 8 is a side sectional view of a pressure valve of the food container using the heating element according to the embodiment of the present invention.

In addition, as shown in FIG. 8, a pressure valve 400 is joined to the vapor discharge hole 260. The pressure valve 400 is formed in a bolt type of which the lower side has a diameter smaller than that of the vapor discharge hole 260, and has a body 410 formed in a truncated cone shape of which the diameter of the lower side gets gradually increased. Moreover, the pressure valve 400 includes: a nut 420 coupled with the lower side of the body 410 below the second extension part 220 of the inner container 200; and a spring 430 mounted on the outer circumference of the body 410 between the nut 420 and the second extension part 220 of the inner container 200.

Therefore, when vapor with a predetermined pressure is generated from the inside of the outer container 100, the vapor discharge hole 260 is opened to discharge vapor while the body 410 of the pressure valve 400 rises by vapor pressure.

Figure 9:
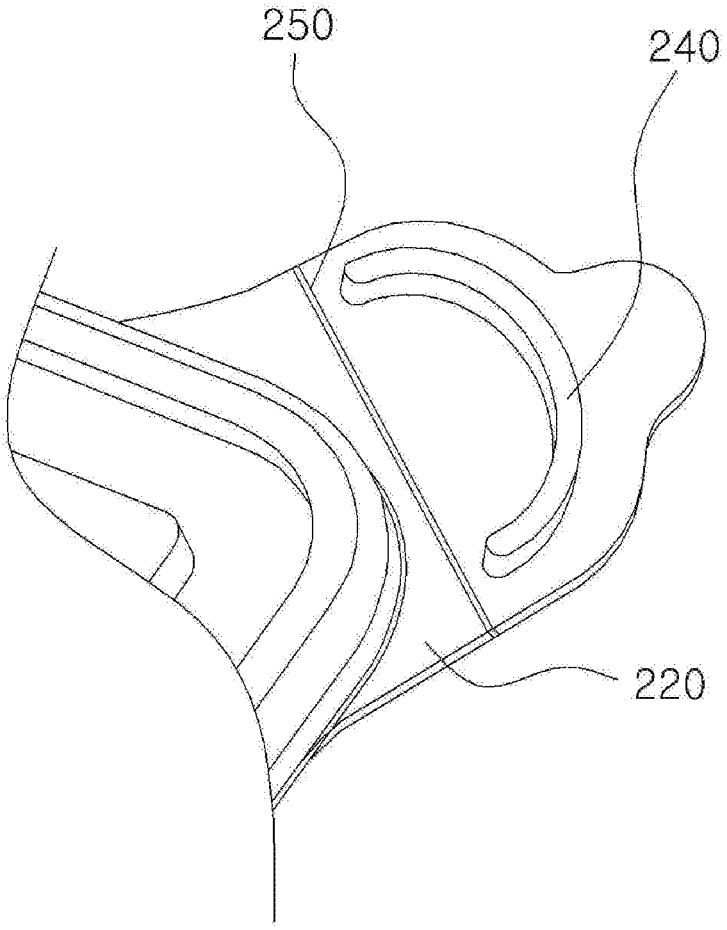
FIG. 9 is an enlarged view showing another form of the second extension part of the food container using the heating element according to the embodiment of the present invention.

Alternatively, referring to FIG. 9, the second extension part 220 of the inner container 200 has a collapsible line 250 formed in a diagonal line between the inner container 200 and the coupling groove 240. The collapsible line 250 gets weaker than the surroundings by external force when the first extension part 120 is spaced apart from the second extension part 220 in order to inject water toward the heating element. After the user injects water into the inflow passage 130, when the first extension part 120 and the second extension part 220 are combined with each other again, a minute gap is formed between the first extension part 120 and the second extension part 220. Therefore, when water is injected through the inflow passage 130 and the heating element generates heat, the vapor generated from the inside of the outer container 100 can be discharged out of the outer container 100 smoothly along the collapsible line 250.

Referring to FIG. 1, the first extension part 120 of the outer container 100 and the second extension part 220 of the inner container 200 respectively include hand-grips 121 and 221 extending from the end portions thereof to the outside. Furthermore, the hand-grip 121 of the first extension part 120 and the hand-grip 221 of the second extension part 220 are out of alignment without overlapping each other. Therefore, when the second extension part 220 is separated upwards from the first extension part 120 in order to inject water into the inflow passage 130, the user can easily open the inflow passage 130 using the misaligned hand-grips 121 and 221.

Likewise, the inner container 200 and the cover 300 respectively have hand-grips 201 and 301 extending outwards from the edge parts. Additionally, the hand-grips 201 and 301 are also out of alignment without overlapping each other.

Moreover, the outer container 100 has a seating recess 150 formed in the middle part of the bottom surface so that the heating element is seated on the seating recess. The seating recess 150 has a heating element containing space having a shape corresponding to that of the heating element, and a water containing space in which water injected through the inflow passage 130 is contained. One side of the seating recess 150 communicates with the inflow passage 130. That is, one end of the inflow passage 130 is located in the middle of the first extension part 120 of the outer container 100 and serves as a water inlet 131, and the other end of the inflow passage 130 communicates with the seating recess 150 of the outer container 100 and serves as a path to transfer water toward the heating element.

Therefore, when water is injected into the inlet 131 of the inflow passage 130 in the state where the first extension part 120 and the second extension part 220 are separated from each other and one end of the inflow passage 130 is opened, the injected water flows into the seating recess 150 of the outer container 100 through the inflow passage 130, so that the heating element causes a heating reaction. In this instance, since the heating element is seated on the seating recess 150, even though the user carries the container, the heating element always located in the middle of the outer container 100 can heat the foods contained in the inner container 200 uniformly.

Figure 2:
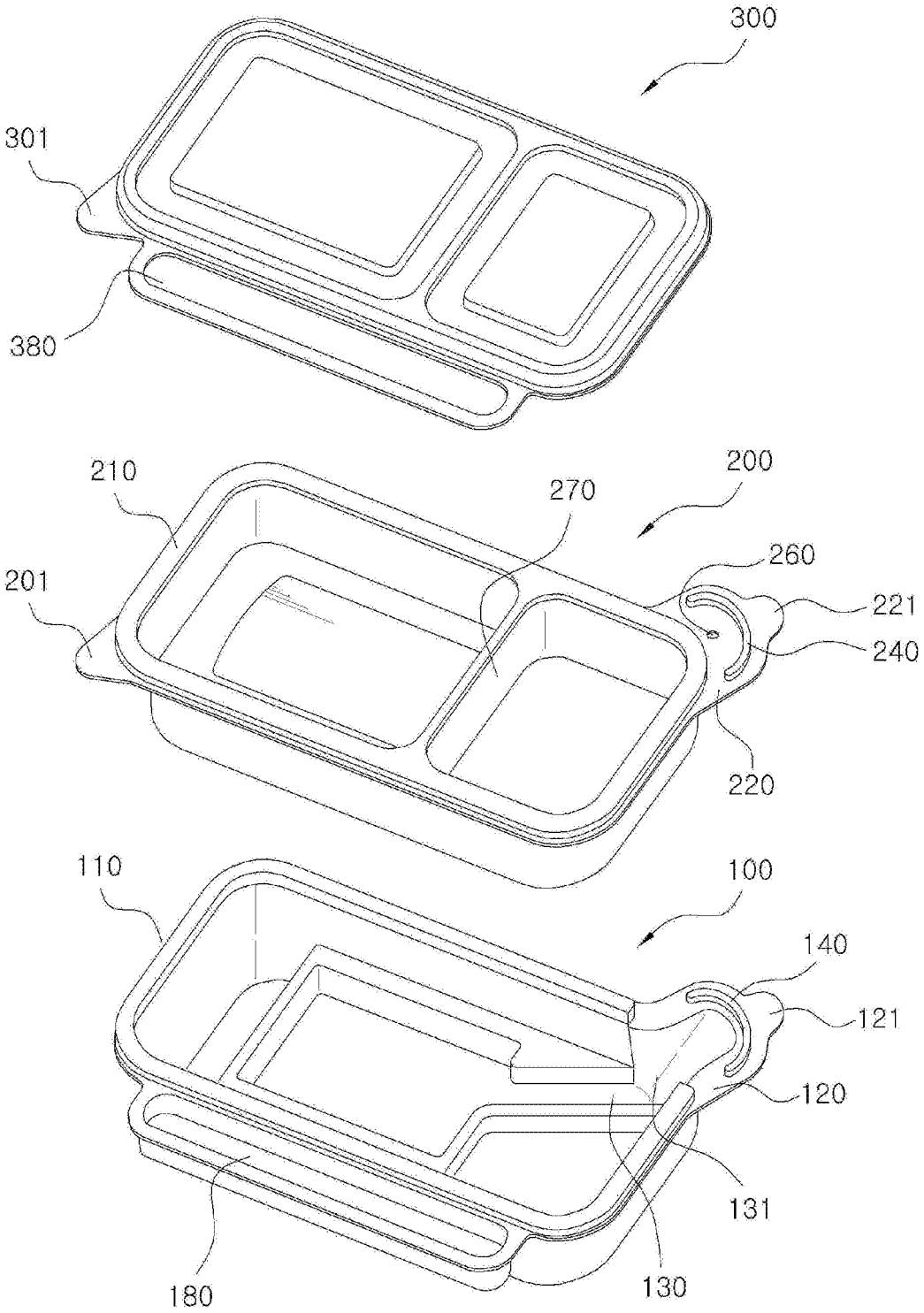
FIG. 2 is an exploded perspective view of the food container using the heating element according to the embodiment of the present invention.
Figure 3:
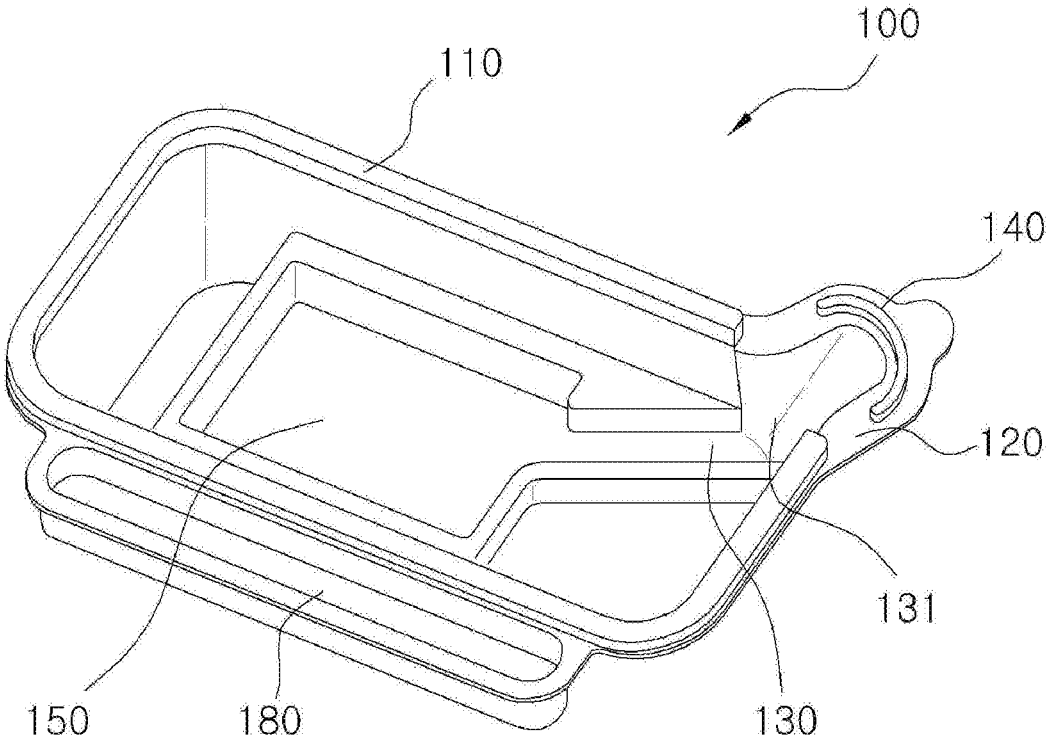
FIG. 3 is a perspective view showing an outer container of the food container using the heating element according to the embodiment of the present invention.
Figure 4:
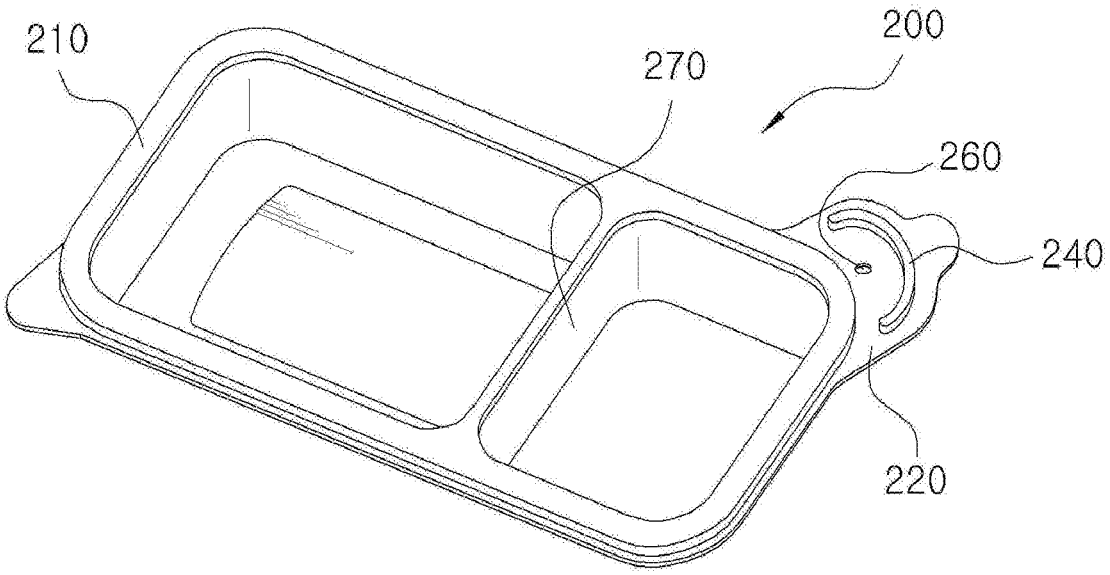
FIG. 4 is a perspective view showing an inner container of the food container using the heating element according to the embodiment of the present invention.
Figure 5:
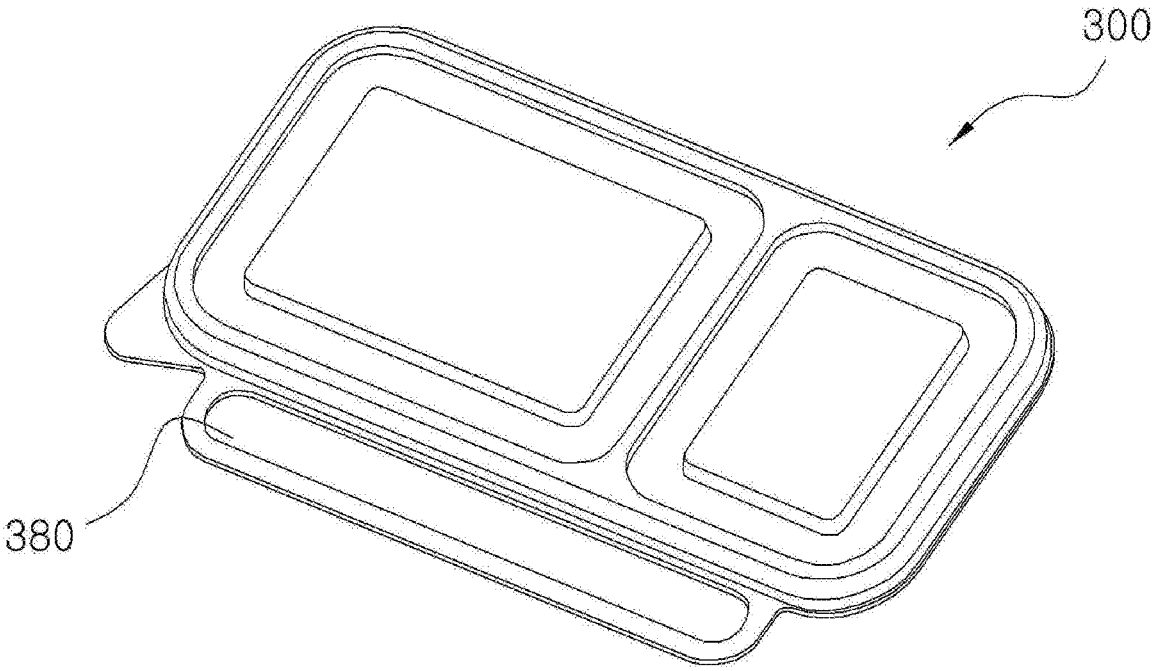
FIG. 5 is a perspective view showing a cover of the food container using the heating element according to the embodiment of the present invention.

Referring to FIGS. 2 and 3, the inner container 200 has one or more partition walls 270 for partitioning a food containing space therein. Therefore, the inner container 200 has two or more food containing spaces, so that foods of at least two kinds can be put in the inner container 200.

Furthermore, the cover 300 has a fitting groove formed at a portion corresponding to the partition walls 270 along the edge portion to be insertion-coupled with the upper edge and the partition walls 270 of the inner container 200. Therefore, the cover 300 can firmly seal the inner container 200.

In the meantime, the outer container 100, the inner container 200 and the cover 300 are respectively formed by plastic injection molding as a disposable food container.

In addition, the outer container 100 has a spoon recess 180 formed integrally at the edge of one side of the outer container 100 so that a spoon is contained therein. Moreover, the cover 300 has a spoon recess cover 380 formed at the edge of one side of the cover 300 and having a shape corresponding to the spoon recess 180 to close the spoon recess 180.

Figure 10:
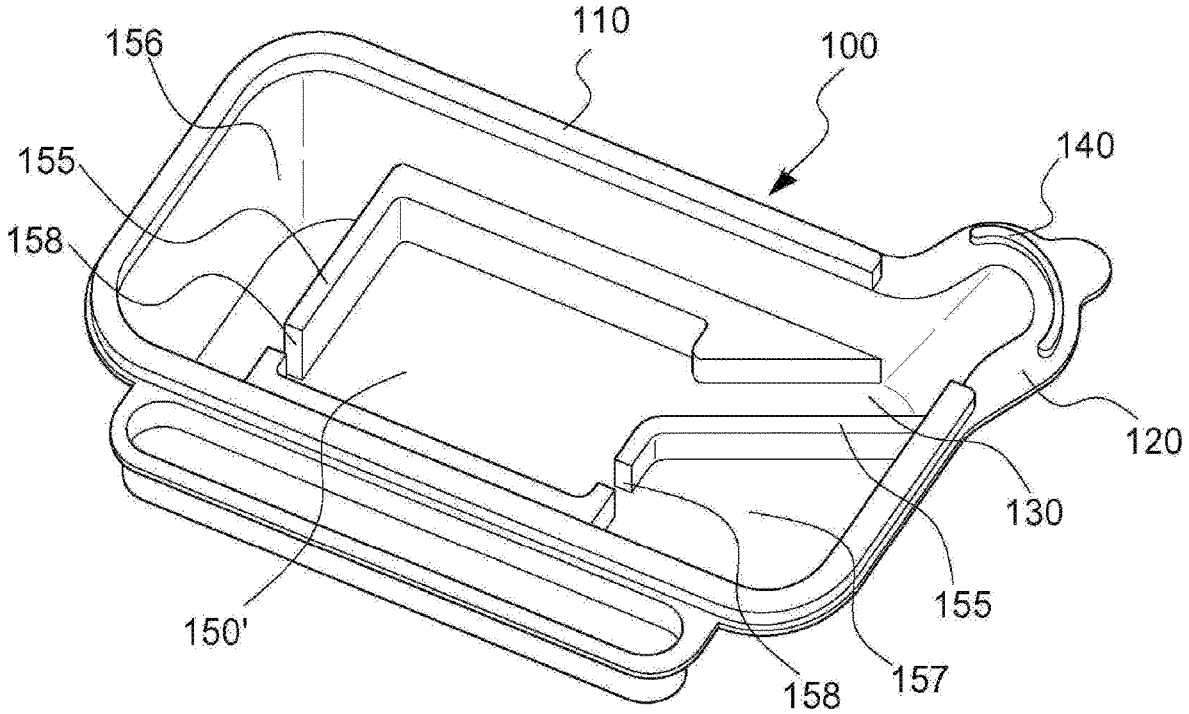
FIG. 10 is a perspective view of a food container using a heating element according to another embodiment of the present invention.
Figure 11:
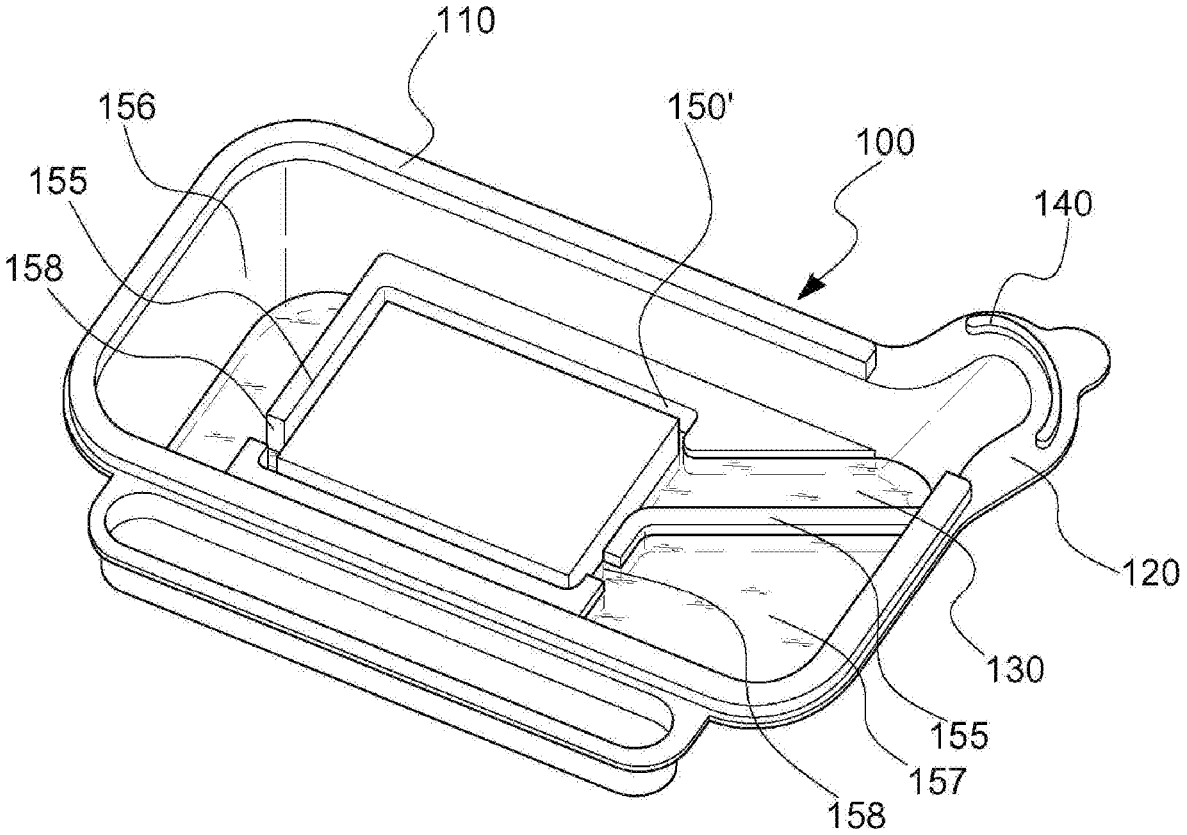
FIG. 11 is a schematically perspective view showing a used state of FIG. 10.

FIGS. 10 and 11 illustrate an outer container 100' of a food container using a heating element according to another preferred embodiment of the present invention.

In FIG. 10, the outer container 100' for receiving the heating element has a seating recess 150' which is formed by protrusion jaws 155 protruding upwards from the intermediate part of the bottom surface and on which the heating element is seated, and also has communication holes 158 formed in the protrusion jaws 155 at the both sides of the heating element to communicate with surplus space parts 156 and 157 formed at both sides of the seating recess 150. Therefore, this embodiment illustrated in FIG. 10 is different from the previous embodiment that the seating recess 150 is an independent space communicating only with the inflow passage 130 by protrusion jaws 155 of the outer container 100.

The seating recess 150' has the shape corresponding to the heating element as the space for receiving the heating element, and one side of the seating recess communicates with the inflow passage 130. Therefore, when water flows into the seating recess 150' through the inlet 131, foods contained in the inner container 200 are heated by heat generated by reaction between the heating element and water, and it is the same as the embodiment illustrated in FIG. 3.

In this embodiment illustrated in FIG. 10, the seating recess 150' has the communication holes 158 formed in the protrusion jaws 155 formed at both sides of the seating recess 150'. When the user injects water into the inflow passage 130, the water flows into the seating recess 150', and then, flows into the surplus space parts 156 and 157 through the communication holes 150'.

When the water in the seating recess 150' is consumed and reduced by the heating reaction between water and the heating element, the water contained in the surplus space parts 156 and 157 flows into the seating recess 150' through the communication hole 158, so that the heating reaction by the heating element and water is kept uniformly and the foods in the inner container can be heated continuously.

In the previous embodiment illustrated in FIG. 3, since the water injected through the inflow passage 130 is contained only in the seating recess 150, if water necessary for the heating reaction of the heating element is injected into the seating recess 150 at once, too much water is contained in the seating recess, and it causes an excessive heating reaction between the heating element and the too much water. So, if the excessive heating reaction causes shortage of water, the foods contained in the food container cannot be heated continuously. In this instance, the user can replenish water by separating the coupling protrusion 140 formed on the first extension part 120 of the outer container 100' from the coupling groove 240 formed in the second extension part 220 of the inner container 200.

However, in this embodiment, since the water is dispersed and contained not only into the seating recess 150' but also into the surplus space parts formed at both sides of the seating recess 150', it prevents the excessive heating reaction due to the too much water in the seating recess and the water contained in the surplus space parts flows into the seating recess 150' through the communication holes 158 when the water in the seating recess is consumed so as to continuously supply water and continuously keep a suitable heating reaction.

As described above, while the present invention has been particularly shown and described with reference to the example embodiments thereof, it will be understood by those of ordinary skill in the art that the above embodiments of the present invention are all exemplified and the protective scope of the present invention should be interpreted by the following claims. Additionally, it will be also understood by those of ordinary skill in the art that various changes, modifications and equivalents may be made therein without departing from the essential characteristics and scope of the present invention. Therefore, it would be understood that all technical ideas within the equivalent scope belong to the technical scope of the present invention.

INDUSTRIAL APPLICABILITY

The present invention is available to lunch boxes configured to heat foods using the heating element.

[Explanation of essential reference numerals in drawings]

| | |
|---|---|
| 100: outer container | 110: coupling rib |
| 120: first extension part | 121: hand-grip |
| 130: inflow passage | 131: inlet |
| 140: coupling protrusion | 150: seating recess |

-continued

[Explanation of essential reference numerals in drawings]

| | |
|---|---|
| 200: inner container | 220: second extension part |
| 221: hand-grip | 240: coupling groove |
| 250: collapsible line | 260: vapor discharge hole |
| 270: partition wall | 300: cover |
| 400: pressure valve | 410: body |
| 420: nut | 430: spring |

The invention claimed is:

1. A food container using a heating element comprising:

an outer container which contains a heating element generating heat by reaction with water and has a first extension part extending outwards from the edge of one side and an inflow passage formed inside the first extension part so that water flows into the outer container; an inner container which contains foods, has a shape corresponding to the outer container to be combined with an upper side of the outer container, and has a second extension part formed at the edge of one side to be coupled with the first extension part of the outer container in order to close the inflow passage; and a cover combined with an upper portion of the inner container, wherein the outer container has a coupling rib protruding upwards along the edge of the upper side and the inner container has a fitting groove formed along the edge of the upper side in such a way that the coupling rib is insertion-coupled with the fitting groove, so that the outer container and the inner container are coupled with each other in an insertion type, and wherein the first extension part has a plate-type flange formed at the edge portion and the intermediate part of the first extension part becomes a part of the inflow passage, the second extension part is formed in a plate-type flange, the first extension part of the outer container has a coupling protrusion protruding upwards from an end portion, and the second extension part of the inner container has a coupling groove formed at an end portion so that the coupling protrusion is insertion-coupled with the coupling groove.

2. The food container according to claim 1, wherein the second extension part of the inner container has a collapsible line formed in a diagonal line between the inner container and the coupling groove.

3. The food container according to claim 1, wherein the second extension part of the inner container has a vapor discharge hole formed between the inner container and the coupling groove and a pressure valve is combined with the vapor discharge hole, and wherein the pressure valve includes:

a body formed in a bolt type of which the lower side has a diameter smaller than that of the vapor discharge hole and having a truncated cone shape of which the diameter of the lower side gets gradually increased;

a nut coupled with the lower side of the body below the second extension part of the inner container; and a spring mounted on the outer circumference of the body between the nut and the second extension part of the inner container.

4. The food container according to claim 1, wherein the first extension part and the second extension part respectively have hand-grips extending outwards, and the hand-grip of the first extension part and the hand-grip of the second extension part are not overlapped with each other but are misaligned.

5. The food container according to claim 1, wherein the outer container has a seating recess formed in the middle part and having a shape corresponding to that of the heating element so that the heating element is not moved, and the seating recess communicates with the inflow passage.

6. The food container according to claim 1, wherein the inner container is partitioned into two or more food containing spaces formed by a partition wall, and the cover has a fitting groove which is coupled with the edge and the partition wall of the inner container in an insertion type.

7. The food container according to claim 1, wherein the outer container further includes: surplus space parts formed at both sides of the seating recess by protrusion jaws protruding upwards from the bottom surface of the seating recess; and communication holes respectively formed in the protrusion jaws at both sides of the seating recess to communication with the seating recess, so that water flowing into the seating recess of the outer container through the inflow passage is dispersed into the surplus space parts, and when the water in the seating recess is consumed by a heating reaction between the heating element and the water, the water contained in the surplus space parts flows into the seating recess to continuously keep the heating reaction of the heating element.

* * * * *